US008061340B2

(12) United States Patent
Mitchell et al.

(10) Patent No.: US 8,061,340 B2
(45) Date of Patent: Nov. 22, 2011

(54) SYSTEM FOR REMOVABLY CONNECTING AN OBJECT TO A WRIST STRAP

(76) Inventors: Lee Robert Mitchell, Midway, GA (US); Glenn Allen Raborn, Athens, TX (US)

( * ) Notice: Subject to any disclaimer, the term of this patent is extended or adjusted under 35 U.S.C. 154(b) by 0 days.

(21) Appl. No.: 10/933,766

(22) Filed: Sep. 3, 2004

(65) Prior Publication Data

US 2006/0048762 A1 Mar. 9, 2006

(51) Int. Cl.
*F41B 5/18* (2006.01)

(52) U.S. Cl. ..... 124/35.2

(58) Field of Classification Search ..... 124/35.2; 24/3.2, 3.12, 3.13; 224/219, 220, 221, 267
See application file for complete search history.

(56) References Cited

U.S. PATENT DOCUMENTS

| | | | | | |
|---|---|---|---|---|---|
| 1,215,283 | A * | 2/1917 | Kirkland | 24/3.6 |
| 3,522,640 | A * | 8/1970 | Lohr | 24/656 |
| 5,209,090 | A * | 5/1993 | Stillwagon | 70/456 R |
| 5,653,214 | A * | 8/1997 | Lynn | 124/35.2 |
| 5,850,825 | A * | 12/1998 | Scott | 124/35.2 |
| 5,857,452 | A * | 1/1999 | Troncoso | 124/35.2 |
| 5,937,841 | A * | 8/1999 | Summers et al. | 124/35.2 |
| 6,056,173 | A * | 5/2000 | Gillespie | 224/247 |
| 6,145,171 | A * | 11/2000 | Hoshino | 24/587.1 |
| 6,484,376 | B1 * | 11/2002 | Khatchadourian et al. | 24/658 |
| 6,487,756 | B1 * | 12/2002 | Vidal, Jr. | 24/3.1 |

* cited by examiner

*Primary Examiner* — John Ricci
(74) *Attorney, Agent, or Firm* — Jeffrey H. Roddy

(57) ABSTRACT

A quick connect/disconnect system for connecting and disconnecting an object, such as an archery release aid, to a wrist strap on a human wrist has a first member adapted to be attached to the wrist strap and a second member adapted to be attached to the object. The first and second members fit together coaxially and can be released by movement of a single lever.

8 Claims, 9 Drawing Sheets

GWS
optional
attachment
10
(internal)
12
14a, 14b
16
180°
130
18
28
26
22
GRA

GWS
optional attachment 1
12
10
14a
14b
18
16
28
26
22
24
GRA

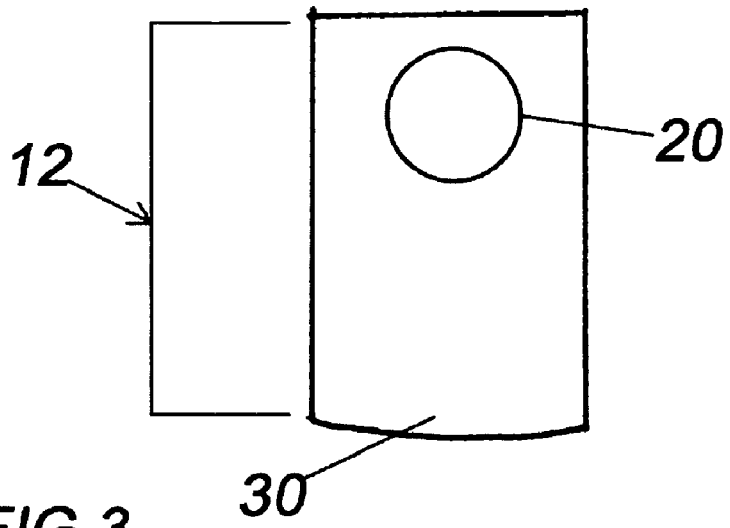
FIG.3
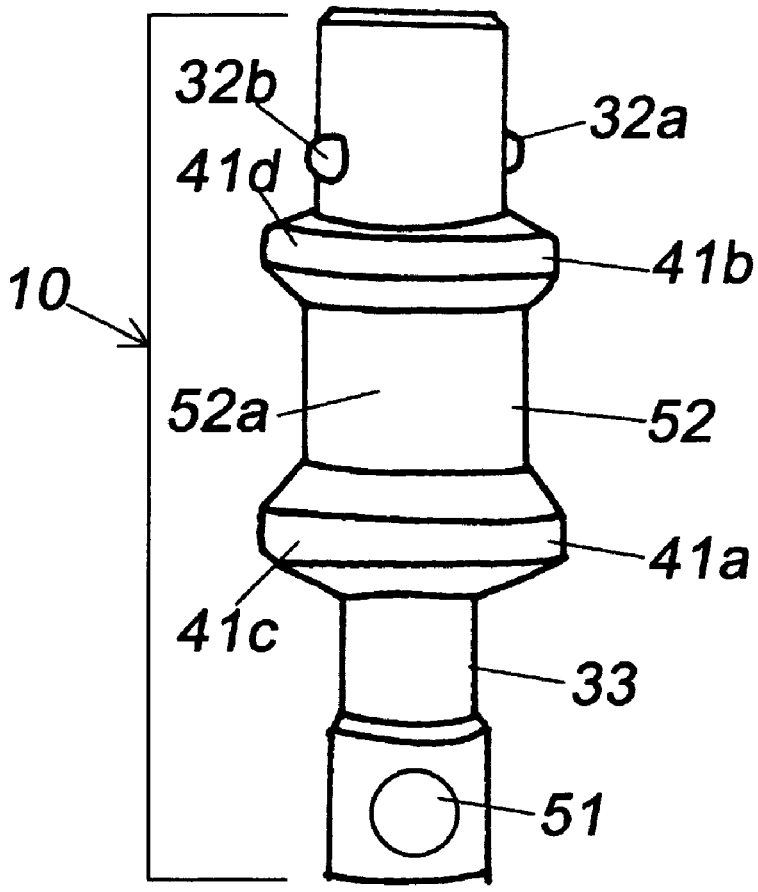

optional attachment 12
14a shown
14b 180°
10
20
GWS
18
40
28a,28b
180°
16
42a shown
42b 180°
26
50
22a
29
22
24
70
130
GRA
90
100

12
20
14a,14b
10
180°
30
18
40
16
50
16a
17
130
28
60
26
70
26a
80
22
90
24
100
GRA

SYSTEM FOR REMOVABLY CONNECTING AN OBJECT TO A WRIST STRAP

BACKGROUND OF THE INVENTION

This application relates to a device for removably connecting an object to a wrist strap. In a preferred embodiment the invention relates to an archery bowstring release aid that is attached to an archer's wrist by a quick release mechanism.

Archery release aids have been developed to assist archers in shooting modern archery bows. A release aid assists an archer when drawing the bowstring back and then further assists the archer when releasing the bowstring. Thus, release aids commonly provide some type of triggering device for smoothly releasing the bowstring. Examples of prior art archery release aids are shown in: U.S. Pat. No. 5,653,213, Aug. 5, 1997, to Linsmeyer for "Bow String Release with Trigger Having Multiple Bow String Securing Positions"; U.S. Pat. No. 5,653,214, Aug. 5, 1997, to Lunn for "Pivotal Bowstring Release Mechanism"; and U.S. Pat. No. 4,831,997, May 23, 1989, to Greene for "Wrist Strap."

Release aids are generally attached to wrist straps to ensure that the archer does not accidentally drop the release aid which could result in harm to the archer or damage to the bow and further to ensure that the release aid is readily available in the event a shot presents itself Some release aids are attached to the archer's wrist via a wrist strap, e.g., a Velcro® or buckle wrist strap such as is shown in the aforementioned U.S. Pat. No. 4,831,997. Release aids are usually joined to wrist straps with a rope or straight-shaft mechanism. In some cases the mechanism can be adjusted to fit an archer's draw length, i.e., distance between the archer's wrist and fingers. However, prior art designs do not offer a means for readily detaching and reattaching the release aid to the wrist strap without removing the entire assembly from the wrist.

While release aids have been beneficial to the archer, there remains a need for improvement. Release aids, which are fixedly attached to a wrist strap when not in use, are problematic. For example, when the archer is not engaged in shooting, the release aid dangles from the wrist and interferes with non-shooting tasks. Dangling release aids tend to snag on clothes, backpacks, and other equipment and the free movement of the release aid tends to interfere with tasks requiring free hands. Although some release aid designs allow the release aid to fold out of the way, tuck away into a shirtsleeve, or pivot back and forth, such designs are somewhat cumbersome.

Fixedly attached release aids can also be an unwanted source of noise and missed shot opportunities. While wearing a release aid, it is difficult to install screw-in or rope tree-steps, climbing sticks, climbing and fixed position deer stands, etc., without clanking the free-swinging release aid against something.

Because of the problems described above, archers often remove their wrist straps and release aids from their wrists while en route to their hunting site. However, the time required to reattach the assembly to the wrist can result in missing a shot opportunity. To reduce the time required to reattach/detach a release aid to/from the wrist, Velcro® has been incorporated into wrist straps. Unfortunately, the loud, unnatural sound that comes from removing or attaching the release aid to the wrist with Velcro® can spook game, resulting in missed shot opportunities. A quiet alternative to Velcro® designs are buckle-type wrist straps, which are quiet when putting on, but take considerable time to attach and detach and, or course, have the disadvantage of the dangling release aid banging on equipment if not detached.

It would be desirable to have a system having a wrist strap with a quick release mechanism that would allow an archer to quickly, quietly, and easily attach and detach an archery release aid to/from a wrist. Accordingly, the present invention provides a release aid which can be readily attached and detached from an archer's wrist without removing the wrist strap, hence, there is no need to suffer a dangling release aid which hinders the archer or produces game spooking noise. Furthermore, the present invention provides a release aid, which can be quietly detached or reattached at any time with minimal effort whenever desired by the archer. Thus, the present invention avoids game spooking noise associated with Velcro wrist straps or time fumbling with buckles. The archer can perform a plethora of tasks without interference of the release aid by simply removing the release aid from the wrist strap. Then, for example, the archer may add or remove clothing, use any accessory while hunting such as binoculars, range finder, or rattling antlers used to lure deer to the hunter by simulating a fight, or simply put hands inside of pockets or muffler for warmth. Of course, the wrist strap may be attached before leaving the vehicle to reduce noise en route and at the hunting site where the release aid may be simply reattached to the wrist strap.

In addition to the above advantages, the release aid of the present invention is convenient and easy to use and is inexpensive to manufacture. Further understanding of the present invention will be had from the following description and claims taken in conjunction with the accompanying drawings.

SUMMARY OF THE INVENTION

In accordance with the present invention a system for removably connecting an object to a wrist strap has:

a) a wrist strap;

b) a first member attached to said wrist strap;

c) a second member adapted to be attached to said object; and said first member and said second member being removably connected to each other by a quick connect/disconnect mechanism.

In a preferred embodiment, the present invention is a system for removably connecting an archery release aid to a wrist, said system having:

(a) a wrist strap;

(b) a first member attached to said wrist strap;

(c) a second member attached to said archery release aid; said first member and said second member being removably connected to each other by a quick connect/disconnect mechanism.

Preferably, the release aid is freely rotatably connected to the second member and the second member comprises a length adjustment element by which the length of the release aid along its longitudinal axis may be adjusted. Also preferably, a safety feature is built into the quick disconnect to prevent an unintentional disconnect of the release aid from the strap fitting. These features enable the archer to fine tune the fit of the release, have a torque free shot for better accuracy, and wear the wrist strap minus the release aid to perform any number of duties without sacrificing a potential shot. If a shot opportunity presents itself the archer can quickly, quietly, and easily reattach the release aid in a matter of seconds.

BRIEF DESCRIPTION OF THE FIGURES

FIG. 3 is a pull-apart Keytag commonly used as a key ring and incorporated into the design of the preferred embodiment of FIG. 1 as the quick connect/disconnect feature;

DETAILED DESCRIPTION OF THE PREFERRED EMBODIMENTS

While the present invention relates broadly to devices for connecting an object to a wrist strap, in a preferred embodiment, the present invention relates to an archery release aid and the invention is specifically described herein as an archery release aid. It will be appreciated by those skilled in the art, however, that the invention is broadly useful to removably attach other devices to a wrist.

Figure 1:
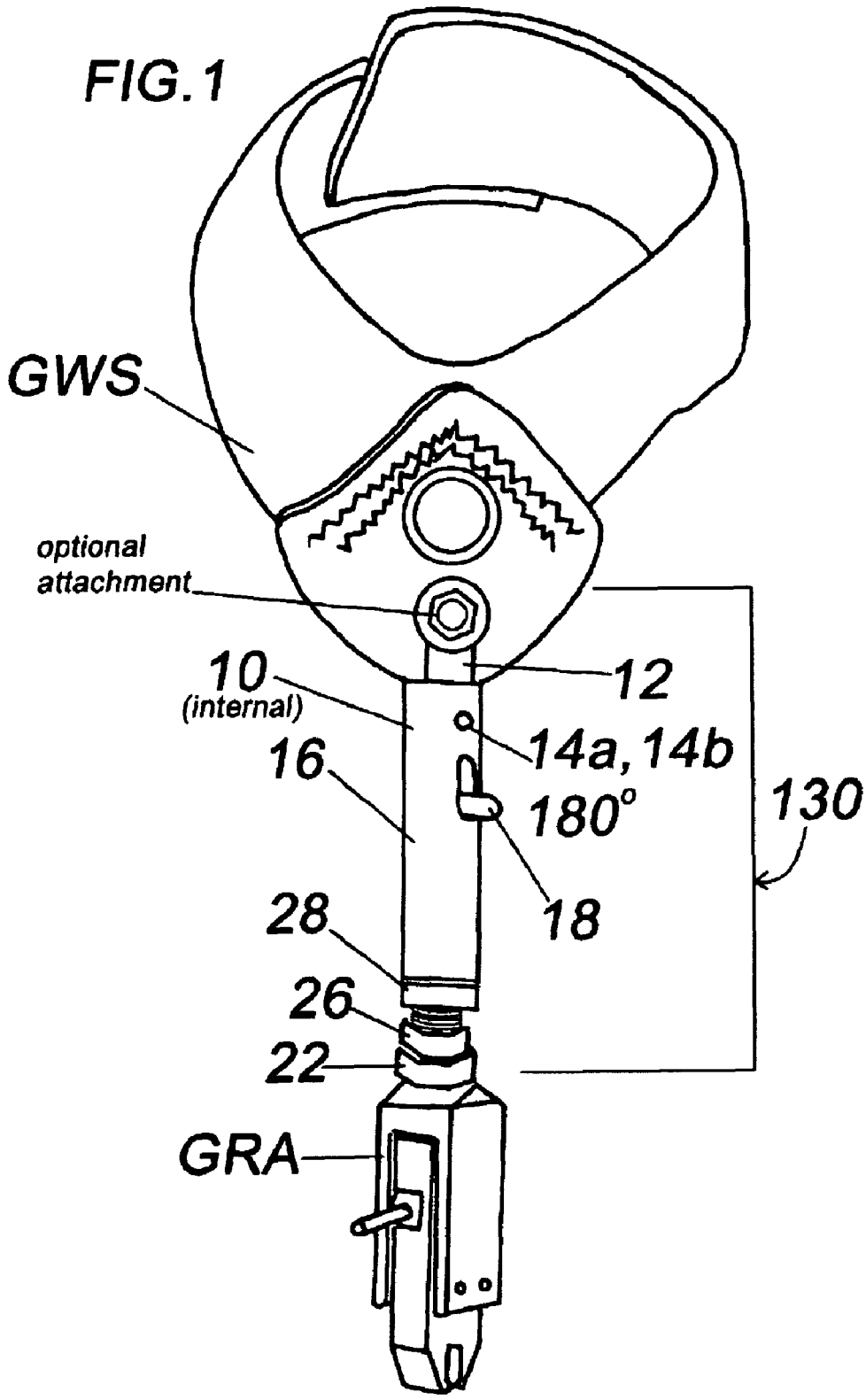
FIG. 1 shows a perspective view of a preferred embodiment of the present invention in operative association with a wrist strap.
Figure 2:
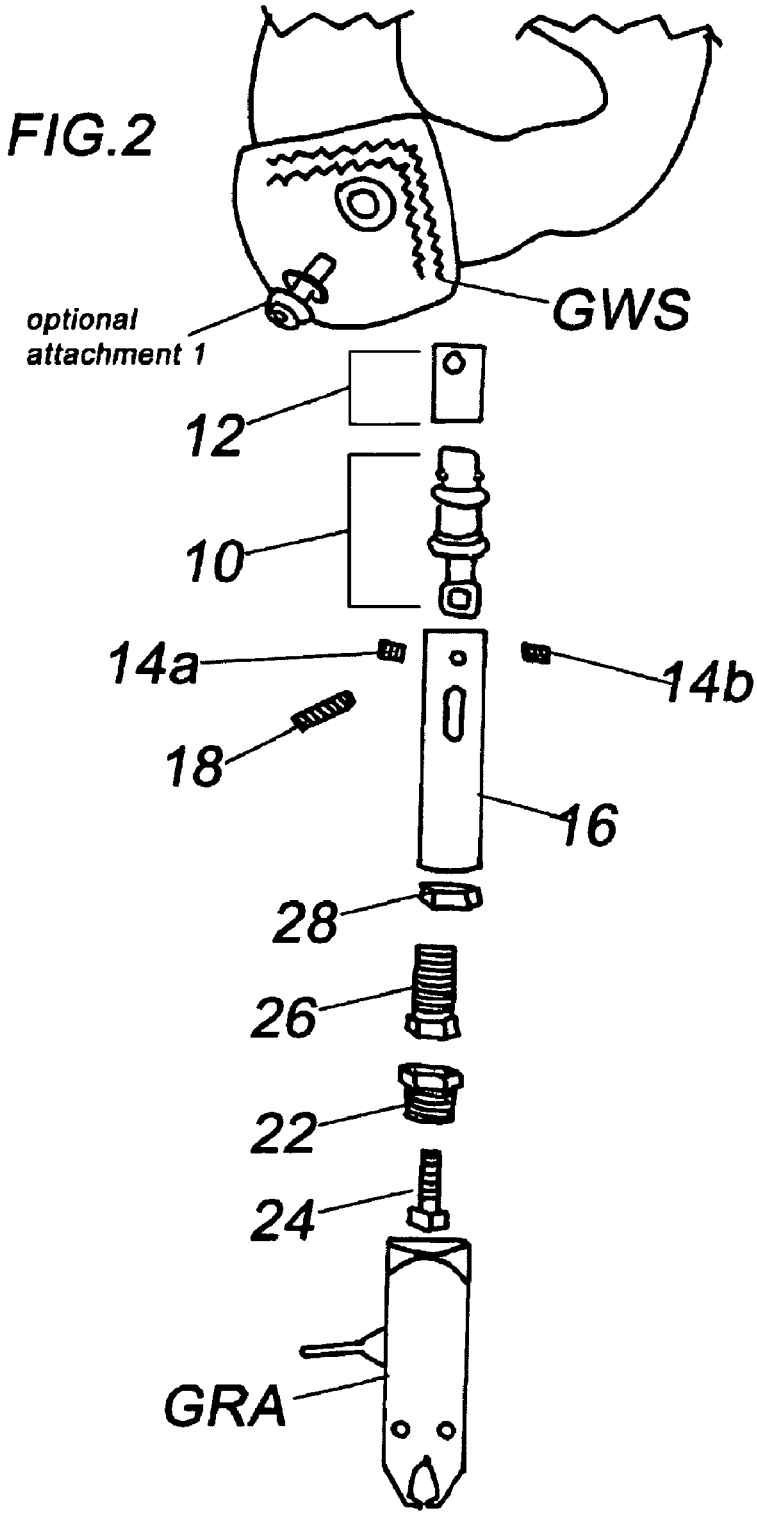
FIG. 2 is an exploded view, in perspective, of the preferred embodiment of FIG. 1.

Now referring to FIGS. 1-2, a preferred embodiment of a system of the present invention is shown and indicated generally by the numeral 130. A first member comprises parts shown as optional attachment 1 for female socket 12, female socket 12, and a wrist strap GWS, which is well known in the art.

Also shown is a second member, which comprises body tube 16, pushpin 18, locknut 28, adjustable screw 26, release aid adapter 22, male connector 10, body tube 16, setscrews 14*a* and 14*b*, pushpin 18, adjustable screw 26, lock nut 28, cap screw 24, and a release aid GRA which is well known in the art. Quick Connect/Disconnect System 130 can be used to secure two members together in a wide variety of applications where quick connect/disconnect of the two members is desirable. However, it has been found that Quick Connect/Disconnect System 130 is particularly suitable for securing a wrist strap GWS to an archery release aid. For the purposes of exemplification herein, Quick Connect/Disconnect System 130 includes wrist strap GWS and release aid GRA. Release aids such as GRA are known in the art and used to draw back and trigger the release of a bowstring in order to launch an arrow as smoothly as possible. The Quick Connect/Disconnect System 130 allows the release aid GRA to be detached from wrist strap GWS without removing the wrist strap GWS from the wrist. Primarily this will reduce noise while hunting as discussed in the Objects and Advantages section of this document and will free up the archer's hands for other tasks when the archer is not actually engaged in shooting.

Male connector 10 and female socket 12 are pull-apart keytag parts, which are readily commercially available. Such keytags parts are preferred in the present invention but it is to be understood that other quick connect/disconnect mechanisms can be used herein without departing from the spirit and scope of the present invention.

FIG. 3 is a pull-apart keytag. Female socket 12 can be attached to wrist strap GWS through aperture 20 of female socket 12 in a plurality of ways. As shown, male connector 10 consists of a plunger 33 that has an existing aperture 51 tapped to mate the thread pitch of pushpin 18. The main body of male connector 10 consists of two shoulders 41*a* and 41*b* and a neck 52. When press-fitted, surfaces 41*c* and 41*d* of shoulders 41*a* and 41*b* come in contact with the internal surface 19*a* of cavity 19 of body tube 16. Male connector 10 is further secured by setscrews 14*a* and 14*b* and tightened against surface 52*a* of neck 52. Ball bearings 32*a* and 32*b* fit into annular groove 35 of female socket 12 when male connector 10 is inserted through aperture 30 into cavity 12*a* of female socket 12.

Figure 4:
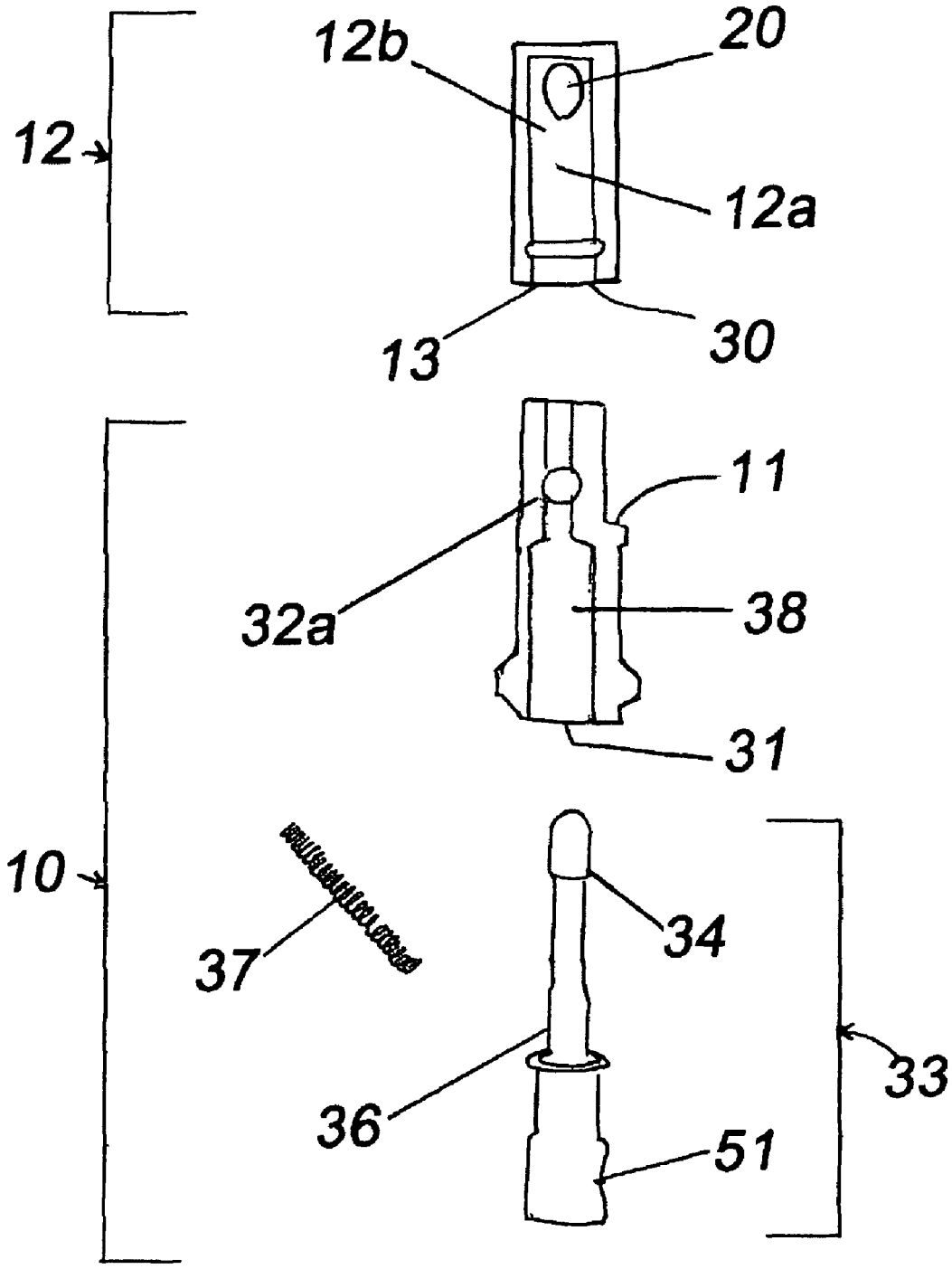
FIG. 4 is an elevational view of a pull-apart Keytag cut longitudinally along its axis.

FIG. 4 is a cross-sectional view of the internal components of the pull-apart keytag male connector 10 and female socket 12. Female socket 12 has an annular groove 35 machined into surface 12*b* of cavity 12*a* to accept two ball bearings 32*a* and 32*b* on male connector 10. Male connector 10 is comprised of a plunger 33 with a shaft 36 that has a bulb 34 on the end that restricts movement of two ball bearings 32*a* and 32*b* when said plunger 33 is not depressed. A spring 37 slides over said shaft 36 and sits above said bulb 34 and ball bearings 32*a* and 32*b*. Plunger 33 has a collar 39 that is larger in diameter than aperture 31 to keep the plunger from pulling out of male connector 10. All parts fit into channel 38 of male connector 10 through aperture 31.

Male connector 10 is inserted into cavity 12*a* through aperture 30 of female socket 12, mating surfaces 11 of male connector 10 and surface 13 of female socket 12 in order to secure the release aid GRA to wrist strap GWS.

Figure 5:
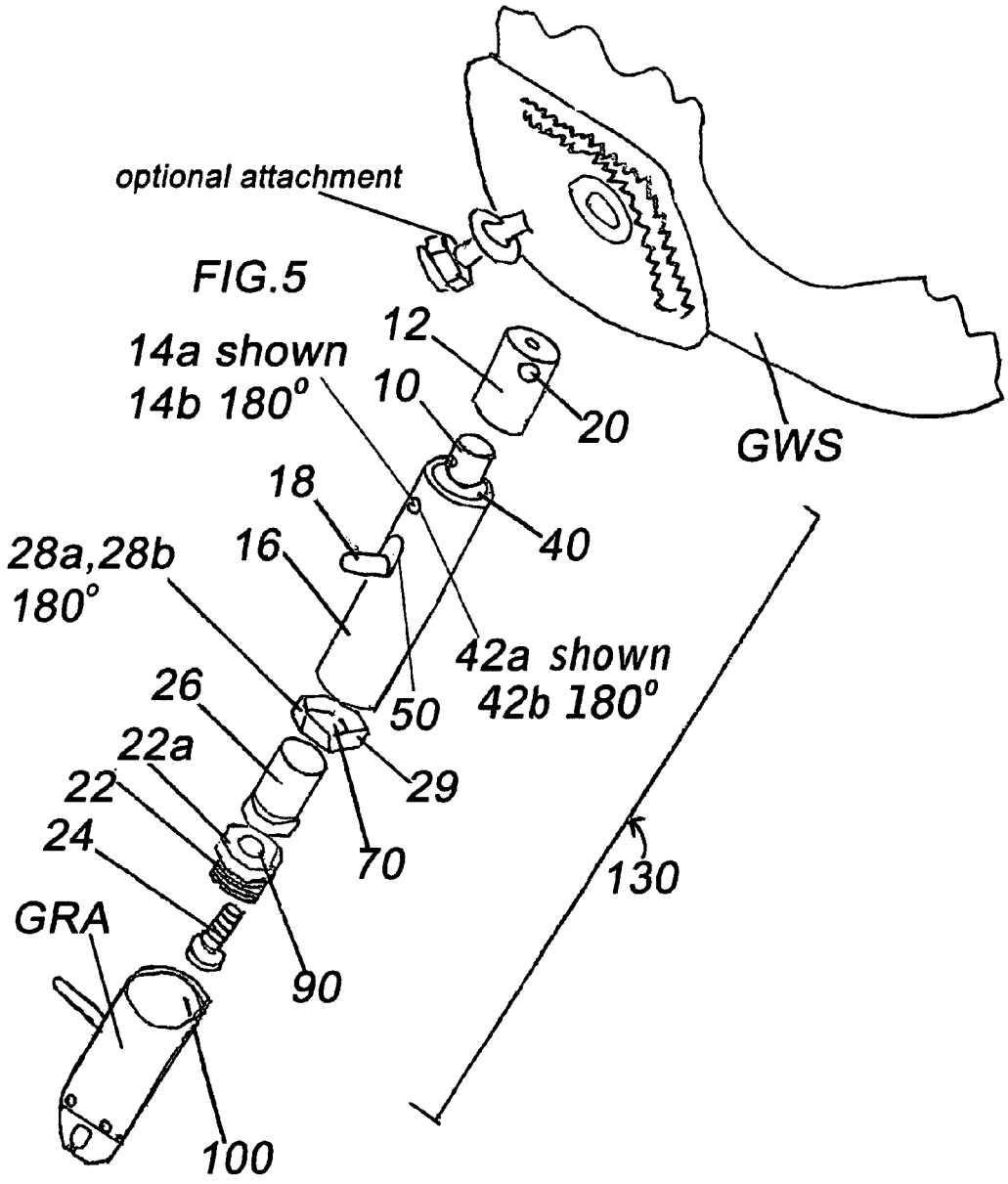
FIG. 5 is an isometric view of the preferred embodiment of the present invention shown in FIGS. 1 and 2 from the wrist strap perspective.
Figure 6:
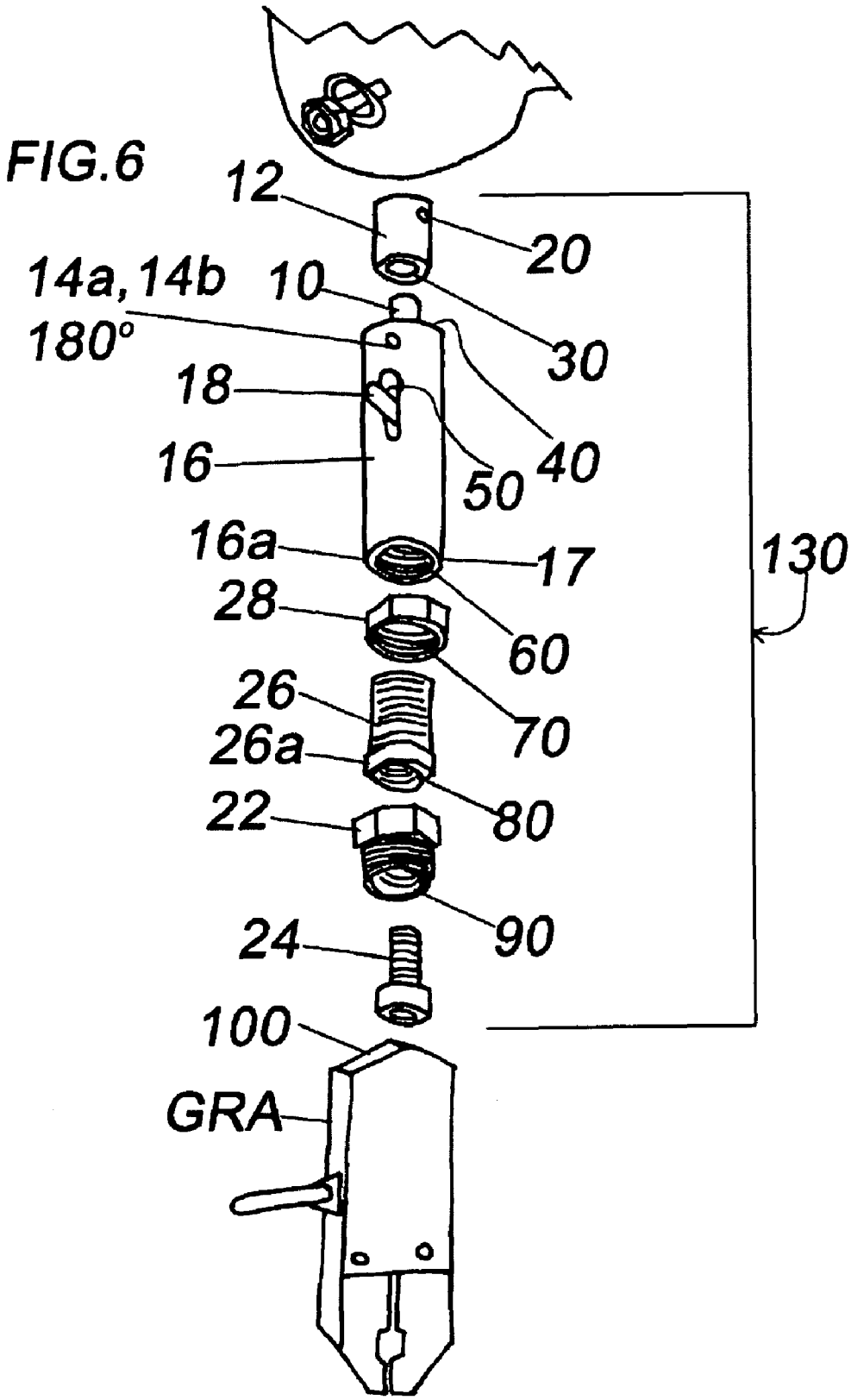
FIG. 6 is an isometric view of the preferred embodiment of the present invention shown in FIGS. 1 and 2 from the release aid perspective showing apertures and surfaces not visible in FIG. 5.
Figure 7:
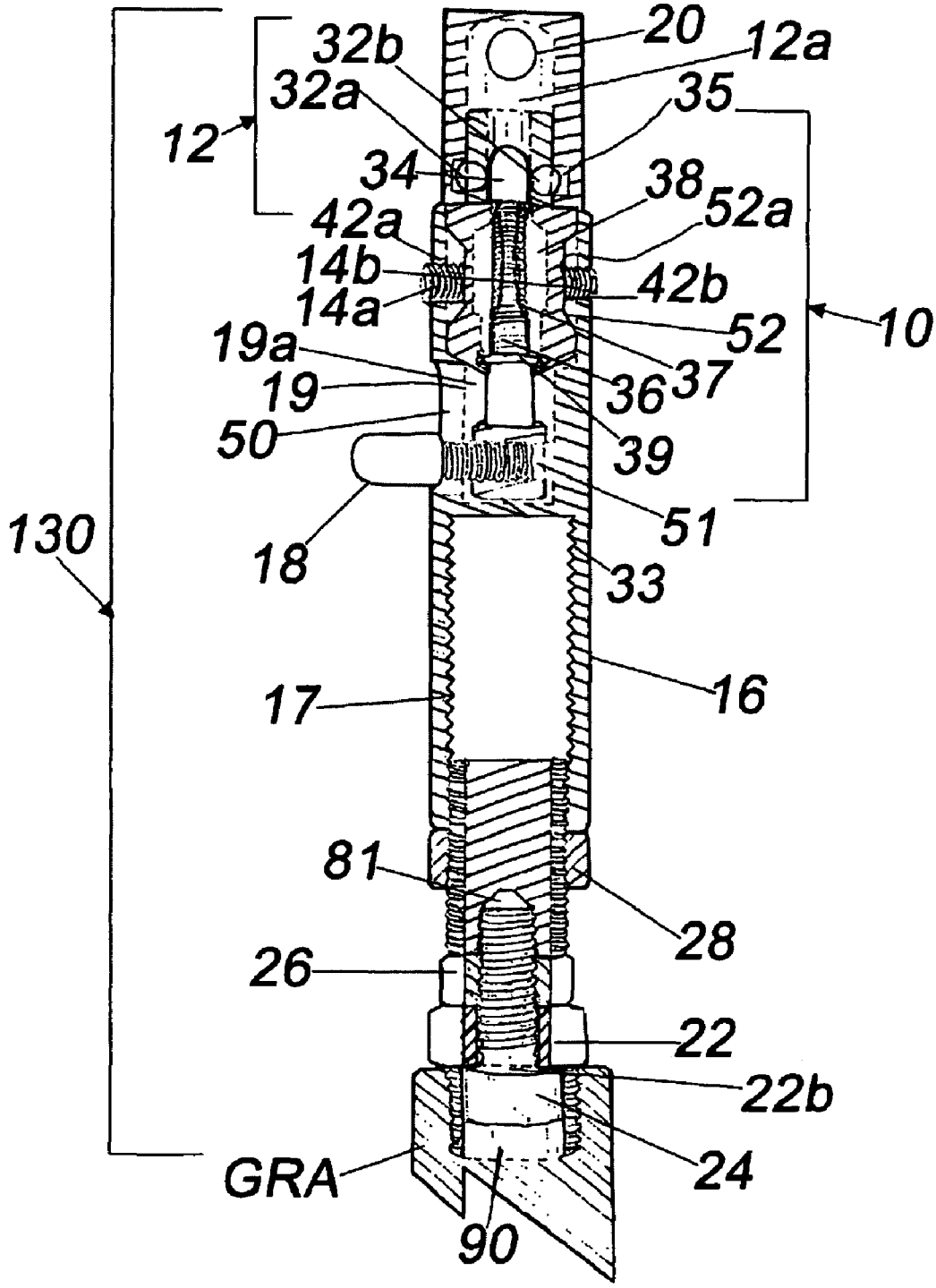
FIG. 7 is a cross-sectional view, broken away and taken along the longitudinal axis of the preferred embodiment of the present invention shown in FIGS. 1 and 2.

Referring to FIGS. 5, 6, and 7, system 130 can be assembled as follows:

Step 1. Female socket 12 is attached to wrist strap GWS. To do so, female socket 12 is attached to wrist strap GWS through existing hole 20 in female socket 12 by any number of means such as a bolt and locking nut optional attachment 1.

Step 2. Male connector 10 is attached to body tube 16. In order to do so, male connector 10 is press fit into cavity 19 through aperture 40 of body tube 16. Screw setscrews 14*a* and 14*b* are threaded into threaded passages 42*a* and 42*b*, respectively, of body tube 16 until both setscrews are seated tightly against surface 52*a* of neck 52 of male connector 10. This offers additional assurance that male connector 10 will remain in cavity 19 of body tube 16.

Step 3. Pushpin 18 is assembled to press fitted male connector 10 by inserting pushpin 18 through passage 50 of body tube 16 and pushpin 18 is screwed into threaded passage 51 of plunger 33 of male connector 10.

Step 4. Surface head 26*a* of adjustment screw 26 is assembled to the surface head 22*a* of release aid adapter 22 by using cap screw 24 to secure assembly. To do so, cap screw 24 is inserted first through counter-bored passage 90 of release aid adapter 22, through passage 80 and into threaded cavity 81 of adjustment screw 26 until the head of cap screw 24 is snug against surface 22*b* of release aid adapter 22 and the heads of the two surfaces 22*a* and 26*a* (FIGS. 4*a*, 4*b*), respectively, are adjacent to one another. Cap screw 24 should be snug but not so tight that release aid adapter 22 does not rotate 360° around said cap screw 24.

Step 5. Lock nut 28 is assembled to adjustment screw 26 by threading adjustment screw 26 through threaded passage 70 of locknut 28. The position of locknut 28 along adjustment screw 26 is left to the archer to decide upon. The locknut's 28 placement determines the ultimate length that will result between the final wrist strap GWS assembly and release aid GRA.

Step 6. The above subassembly resulting from steps 4-5 is threaded into the body tube 16 subassembly from steps 2-3. To do this, adjustment screw 26 is threaded into mating cavity 17 through passage 60 of body tube 16 until surface 16*a* of body tube 16 is adjacent to surface 29 of locknut 28. To secure these parts, a wrench is used on flat head surfaces 28*a* and 28*b* of locknut 28 and hex head of adjustment screw 26. Opposing pressure is applied to adjustment screw 26 in a counterclockwise direction while pressure is applied to locknut 28 in a clockwise direction in order to tighten surface 29 of locknut 28 against surface 16*a* of body tube 16. It should be noted that before tightening locknut 28, the archer can fine-tune the length of this assembly by merely adjusting passage 60 of body tube 16 and passage 70 of locknut 28 all along the threads of adjustment screw 26. Once the desired length is achieved locknut 28 can be tightened down in the above manner.

Step 7. Release aid adapter 22 is threaded into existing aperture 100 in release aid GRA by applying one wrench to surfaces 22*c* and 22*d* of release aid adapter 22 and another wrench to the hex head of adjustment screw 26. Opposing pressure is applied in a clockwise direction to release aid adapter 22 and counterclockwise to adjustment screw 26 until the release aid GRA is firmly attached to the preferred embodiment 130. Release aid adapter 22 and adjustable screw 26 are joined together by cap screw 24. In a preferred embodiment, release aid adapter 22 includes a standard Archery Manufacturers and Merchants Organization (AMO) thread pitch for archery release accessories; however, other mating thread pitches are suitable.

Figure 8:
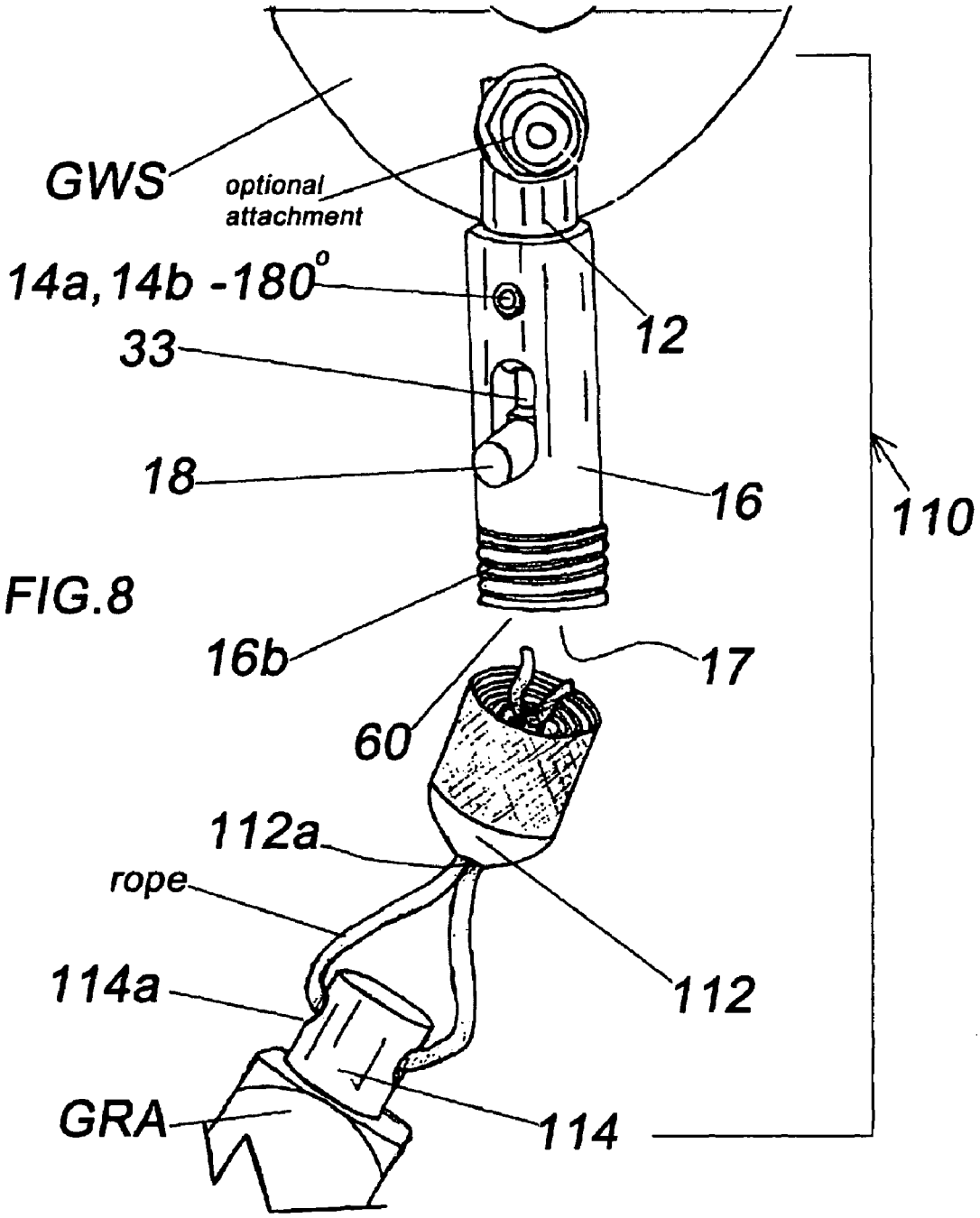
FIG. 8 is a perspective view showing an alternative preferred embodiment of the present invention with a portion broken away.

FIG. 8 shows an alternative embodiment 110 of the present invention. System 110 uses the same Quick Connect/Disconnect System as preferred embodiment 130. The length and torque free 360° swivel are realized through the use of a rope, which secures release aid GRA to body tube 16. The rope goes through hole 114*a* of modified release aid adapter 114 and both ends of the rope are threaded through hole 112*a* of body tube cap 112. Both ends of the rope are knotted together when the desired length between the release aid GRA and wrist strap GWS is determined. The knot then goes through passage 60 and into cavity 17 (which is not threaded in this embodiment) of body tube 16. Body tube cap 112 mates to threads 16*b* on the outside of body tube 16. In this alternative embodiment A 110, the modified release aid adapter 114 includes a standard Archery Manufacturers and Merchants Organization (AMO) thread pitch for archery release accessories; however, other mating thread pitches are suitable.

Figure 9:
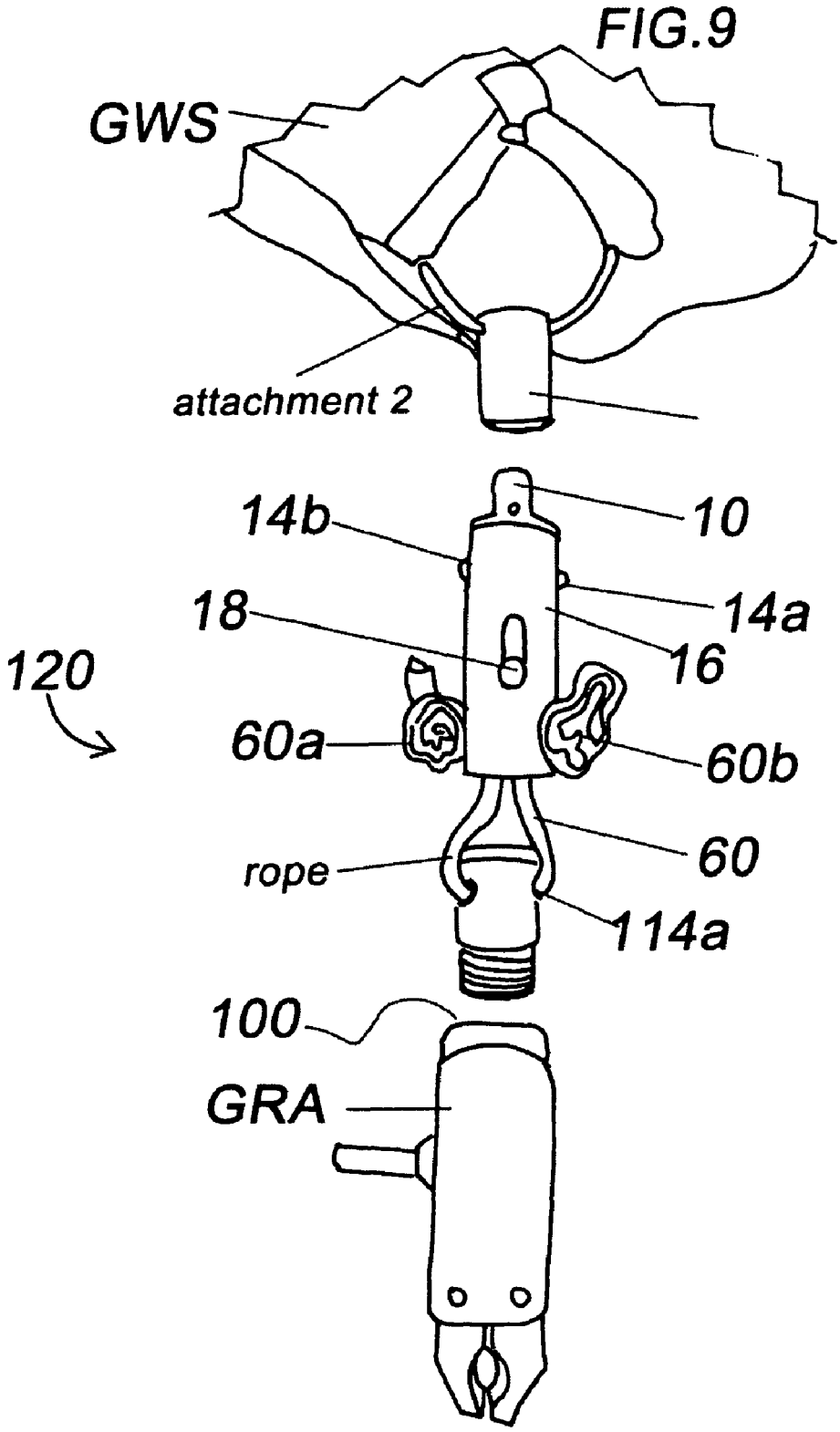
FIG. 9 is a perspective view of another alternative preferred embodiment of the present invention shown in detached configuration.

FIG. 9 is yet another alternative embodiment 120 of the present invention. Alternative embodiment 120 uses the same quick connect/disconnect system as preferred embodiment 130. The length adjustment and torque free 360° swivel are realized through the use of a rope that secures the release aid GRA to body tube 16. A rope goes through hole 114*a* in modified release aid adapter 114. The two ends of the rope are inserted into passage 60 and one end goes out passage 60*a* and the other out passage 60*b*. Knots are tied in the two ends of the rope at the desired length that are large enough not to pull back through passages 60*a* and 60*b*. In alternative embodiment 120, the modified release aid adapter 114 includes a standard Archery Manufacturers and Merchants Organization (AMO) thread pitch for archery release accessories; however, other mating thread pitches are suitable.

In operation, all wrist strap type release aids currently on the market require the archer to physically remove the wrist strap in order to remove the release aid for any reason. The manner of using the Quick Connect/Disconnect System 130 is unique to all other wrist strap type archery release aids in that the release aid can quickly, quietly, and easily be detached from the wrist strap to free up the hands of the archer and reattached to the wrist-strap in seconds when needed. To disconnect the release aid GRA from the wrist strap GWS, the archer simply grasps body tube 16 with his/her free hand, slides pushpin 18 towards the wrist while simultaneously pulling body tube 16 and release aid GRA from the wrist. In so doing, plunger 33 depresses spring 37, and moves bulb of shaft 34 down past ball bearings 32*a* and 32*b* allowing them to fall into channel 38 and disengage from annular groove 35 in female socket 12. This leaves only the wrist strap GWS and female socket 12 attached to the archer's wrist. To reconnect the release aid GRA to the wrist strap GWS the archer simply slides pushpin 18 away from release aid GRA and simultaneously inserts male connector 10 into cavity 12*a* through aperture 30 of female socket 12, releases pushpin 18, allowing bulb of shaft 34 to slide upwards pushing ball bearings 32*a* and 32*b* into annular groove 35 in female socket 12 thus reattaching release aid GRA to the wrist strap GWS.

Because the fit of a release aid is so crucial to proper form and smooth release when shooting a bow and arrow, a fine length adjustment feature is machined into preferred embodiment 130. To adjust the preferred embodiment 130, locknut 28 is loosened with a wrench applied to the two flat sides 28*a* and 28*b* of lock nut 28 and another on the hex head of adjustable screw 26. Adjustable screw 26 is then simply screwed in or out until the perfect fit for the archer is achieved, and locknut 28 is tightened back down to secure the fit. Alternative embodiment 110 is connected/disconnected in the same manner as preferred embodiment 130. However, to adjust the length, body tube cap 112 is removed by simply unscrewing body tube cap with the archer's fingers, the rope either shortened or lengthened, the knot retied and body tube cap 112 replaced and retightened. Alternative embodiment 120 is connected/disconnected in the same manner as preferred embodiment 130. Again a rope is used as the length adjustment feature. Both ends of the rope coming from the release aid GRA are threaded through aperture 60 of body tube 16 and one end of the rope threaded through hole 60*a* and the other end threaded through hole 60*b*. A knot larger than hole 60*a* and 60*b* is then tied in the end of each rope to set the length.

A torque free 360° swivel feature for the release aid is achieved by inserting cap screw 24 into the counter-bored interior of release aid adapter 22 and threading it into adjustable screw 26. The inside of release aid adapter 22 is smooth to allow the release aid adapter to rotate freely around the head of cap screw 24 once it is screwed into cavity 81 through aperture 60 of adjustable screw 26. In alternative embodiments 110, and 120, the rope provides a torque free shot because it allows the release aid GRA to rotate to the correct position when the bowstring is pulled back.

From the description above, a number of advantages of the release aid of the present invention over the prior art become evident:

a) The release aid can be detached quickly, quietly, and easily without removing the wrist strap and any number of duties requiring the archer to have free hands can be performed.

b) The release aid can be quickly and easily reattached—within seconds—to the archer's wrist with no noise and minimal movement.

c) The release can be precisely fit to the archer using the fine adjustment screw, or in an alternative embodiment by adjusting the length of rope securing the release aid to the body tube.

d) The release aid is completely torque free due to the 360° rotation of the release aid adapter.

Although the description above and detailed drawings of the preferred and alternative embodiments contain much specificity, these should not be construed as limiting the scope of the invention but as merely providing illustrations of some of the presently preferred embodiments of this invention. For example, the Quick Connect/Disconnect System 130 could be modified in many ways to obtain the desired effect of removing the release aid from the wrist strap without departing from the spirit and scope of the present invention. Synthetic materials or different alloys could be used in manufacturing, the parts could be reduced or enlarged so as to adapt to larger or smaller archers, etc. Thus the scope of the invention should be limited only by the appended claims.

What is claimed is:

1. A quick connect/disconnect system for removable connecting and disconnecting a bowstring release to a wrist of a user, said system comprising:

a) a wrist strap;

b) a first member attached to said wrist strap; and c) a second member adapted to be attached to said bowstring release, said first member being in telescoping relationship with said second member and being removably connected thereto by a quick connect/disconnect mechanism, and said mechanism having a pin which projects externally and laterally from said telescoping relationship, and which is moved by a user's fingers in a linear direction to release said first member from said second member in a single motion.

2. The quick connect/disconnect system of claim 1 wherein each said first and second members are elongated cylindrical members and wherein an end portion of one member is coaxial with an end portion of the other member when said members are connected to each other.

3. The quick connect/disconnect system of claim 1 further including a means for disengaging said second member from said first member to separate said wrist strap from said bowstring release.

4. The quick connect/disconnect system of claim 1 further including a mechanism for adjusting the distance between said second member and said bowstring release.

5. The quick connect/disconnect system of claim 1 wherein said bowstring release is a release aid rotatably connected to said second member.

6. A quick connect/disconnect system for removably connecting and disconnecting a bowstring release to a wrist of a person comprising:

a wrist strap; and, a first member pivotably attached to the wrist strap (GWS) to include a female socket (12); and, a second member including at least;

(i) a body tube (16), and (ii) a slide-able pushpin (18) projecting transversely from the body tube (16), and (iii) a male connector (10) removably positionable within the body tube (16), and the male connector engagable with the female socket to secure the first and second members together, and the first and second members disengagable in a single motion by slidably moving the pushpin.

7. The quick/connect disconnect system of claim 6 further comprising a mechanism for adjusting the distance between the second member and the bowstring release.

8. The quick/connect disconnect system of claim 6 in which the bowstring release is rotatably connected to the second member.

* * * * *